US007789475B2

(12) United States Patent
Morishita et al.

(10) Patent No.: US 7,789,475 B2
(45) Date of Patent: Sep. 7, 2010

(54) IMAGE FORMING APPARATUS

(75) Inventors: Takashi Morishita, Kanagawa (JP); Yoshimitsu Ogura, Kanagawa (JP); Kenji Kagami, Kanagawa (JP); Jun Watanabe, Tokyo (JP); Yuji Ieiri, Kanagawa (JP); Tomokazu Tsuchiya, Kanagawa (JP); Shigeru Yoshigai, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 364 days.

(21) Appl. No.: 12/076,366

(22) Filed: Mar. 18, 2008

(65) Prior Publication Data

US 2008/0225070 A1 Sep. 18, 2008

(30) Foreign Application Priority Data

Mar. 18, 2007 (JP) ..... 2007-069700

(51) Int. Cl.
*B41J 29/393* (2006.01)

(52) U.S. Cl. ..... 347/19; 347/10

(58) Field of Classification Search ..... 347/9–12, 347/19; 358/504; 340/653
See application file for complete search history.

(56) References Cited

U.S. PATENT DOCUMENTS 5,297,881 A * 3/1994 Ishiyama ..... 400/705
5,302,944 A * 4/1994 Curtis ..... 340/653

FOREIGN PATENT DOCUMENTS

| | | |
|---|---|---|
| JP | 2001-334643 | 12/2001 |
| JP | 2002-225374 | 8/2002 |
| JP | 2006-007441 | 1/2006 |
| JP | 2007-083636 | 4/2007 |

* cited by examiner

*Primary Examiner*—Lamson D Nguyen
(74) *Attorney, Agent, or Firm*—Harness, Dickey & Pierce, P.L.C.

(57) ABSTRACT

In an image forming apparatus, a control unit determines that dirt is present on the linear scale when a detecting unit detects a change in a moving direction of a moving member while the moving member is moving at a constant speed.

11 Claims, 15 Drawing Sheets

FIG. 9
| BEFORE TRANSITION | | AFTER TRANSITION | | CARRIAGE MOVING DIRECTION |
|---|---|---|---|---|
| A PHASE | B PHASE | A PHASE | B PHASE | |
| 0 | 0 | 0 | 1 | FORWARD |
| 0 | 1 | 1 | 1 | FORWARD |
| 1 | 1 | 1 | 0 | FORWARD |
| 1 | 0 | 0 | 0 | FORWARD |
| 0 | 0 | 1 | 0 | BACKWARD |
| 1 | 0 | 1 | 1 | BACKWARD |
| 1 | 1 | 0 | 1 | BACKWARD |
| 0 | 1 | 0 | 0 | BACKWARD |
FIG. 10
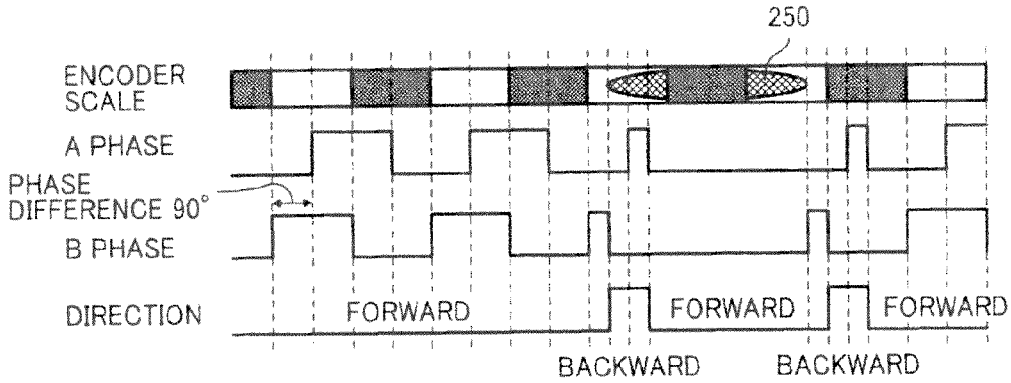
FIG. 11
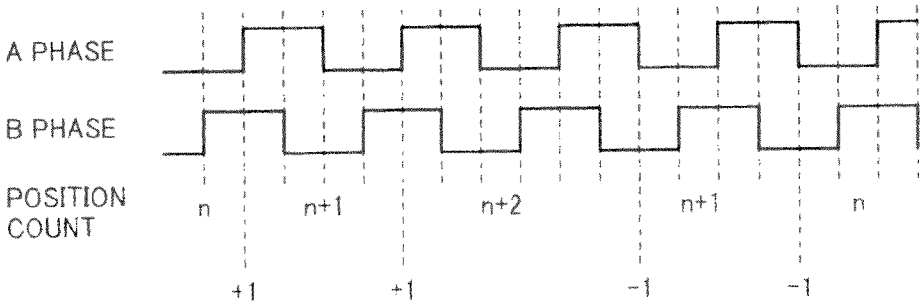

IMAGE FORMING APPARATUS

CROSS-REFERENCE TO RELATED APPLICATIONS

The present application claims priority to and incorporates by reference the entire contents of Japanese priority document, 2007-069700 filed in Japan on Mar. 18, 2007.

BACKGROUND OF THE INVENTION

1. Field of the Invention

The present invention relates to a technology of detecting dirt on a linear scale in an image forming apparatus.

2. Description of the Related Art

Various types of image forming apparatuses, such as a printer, facsimile, copier, plotter, and a multifunction product combining functions of printing, faxing, and copying, include a serial-type image forming apparatus and a line type image forming apparatus. In the serial-type image forming apparatus, a carriage carrying a recording head including liquid ejection heads for ejecting droplets of a liquid (hereinafter "ink") is caused to scan serially in a direction perpendicular to a conveying direction of a record-bearing medium (hereinafter "sheet", which can be made of paper or other nonpaper materials, and can also called "recording medium", "recording paper", or "printing material") as the record-bearing medium is conveyed intermittently according to a recording width, so that conveying and recording is repeated alternately to form an image (i.e., to record and print characters and images, etc.) on the record-bearing medium. In the line-type image forming apparatus, on the other hand, recording is carried out while conveying the record-bearing medium without moving the recording head.

For example, for the serial-type image forming apparatus, to form a high quality image by causing the recording head to eject recording liquid droplets to given spots on the sheet, it is important to ensure the constant speed of the carriage, which is a moving member carrying the recording head, and the sheet-feeding precision of a conveying unit. Generally, a direct current (DC) motor is used as a driving source for moving the carriage and conveying unit, which are driven under servo control.

In detecting the position of the carriage through DC servomotor control, however, if a linear scale (also called as encoder sheet), which composes a linear encoder for obtaining position/speed information, becomes dirty with attachment, such as ink, and grease or oil applied to a guide rod for guiding the movement of the carriage, a detection signal from the linear encoder (reading signal from the linear scale) becomes inaccurate to make it difficult to accurately detect the position of the carriage.

A technology is disclosed in Japanese Patent Application Laid-Open No. 2002-225374, in which a mode for detecting dirt on a linear scale is provided to count the number of slits formed on the linear scale for detecting the presence/absence of the dirt. When it is detected that the dirt is present on the linear scale, the position of the dirt is calculated.

Furthermore, an image forming apparatus is disclosed in Japanese Patent Application Laid-Open No. 2006-007441, which does not detect dirt on a linear scale but detects the speed or position of a moving body based on a reading signal output from an encoder in response to the displacement of the moving body, and which controls the displacement of the moving body based on a result of the detection. The image forming apparatus is provided with a unit that determines whether the reading signal is normal based on the signal width of the reading signal and a preset signal width while the moving body is displaced at a constant speed.

According to the configuration described in Japanese Patent Application Laid-Open No. 2002-225374, the number of slits formed on the linear scale is counted to detect the presence/absence of the dirt in the dirt detection mode, and the position of the dirt is detected through calculating on the counted number. Such configuration, therefore, has problems that a specific mode for detecting the dirt is necessary and that easily grasping the position of the dirt is difficult.

SUMMARY OF THE INVENTION

It is an object of the present invention to at least partially solve the problems in the conventional technology.

According to an aspect of the present invention, there is provided an image forming apparatus including a moving member; a linear encoder that includes a linear scale and an encoder sensor for reading the linear scale and that detects a position of the moving member; a detecting unit that detects a moving direction of the moving member; and a control unit that determines that dirt is present on the linear scale when the detecting unit detects a change in the moving direction of the moving member while the moving member is moving at a constant speed.

According to another aspect of the present invention, there is provided an image forming apparatus including a moving member; a linear encoder that includes a linear scale and an encoder sensor for reading the linear scale and that detects a position of the moving member; a detecting unit that detects a moving direction of the moving member; a setting unit that sets a changing position at which the moving member changes a moving direction; and a control unit that determines that dirt is present on the linear scale when the detecting unit detects a change in the moving direction of the moving member before the linear encoder detects that the moving member reaches the changing position.

According to still another aspect of the present invention, there is provided an image forming apparatus including a recording head that is configured to move; a linear encoder that includes a linear scale and an encoder sensor for reading the linear scale and that detects a position of the recording head; a control unit that determines a print timing based on a signal from the linear encoder and outputs a drive waveform for driving the recording head based on the print timing; and a determining unit that determines, when an instruction for detecting dirt on the linear scale is received, a ratio of a time interval from the print timing to an output time period of a signal for causing the recording head to perform printing to be different from that for normal image formation, and forms an image on a recording medium that can be used to check if dirt is present on the linear scale.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 9 is a table for explaining a relation between a state transition of an A phase and a B phase and a carriage moving direction;

FIG. 10 is a schematic diagram for explaining a reading signal when dirt is on a linear scale;

FIG. 11 is a schematic diagram for explaining a method of calculating a carriage position;

DETAILED DESCRIPTION OF THE PREFERRED EMBODIMENTS

Exemplary embodiments of the present invention are explained in detail below with reference to the accompanying drawings.

Figure 1:
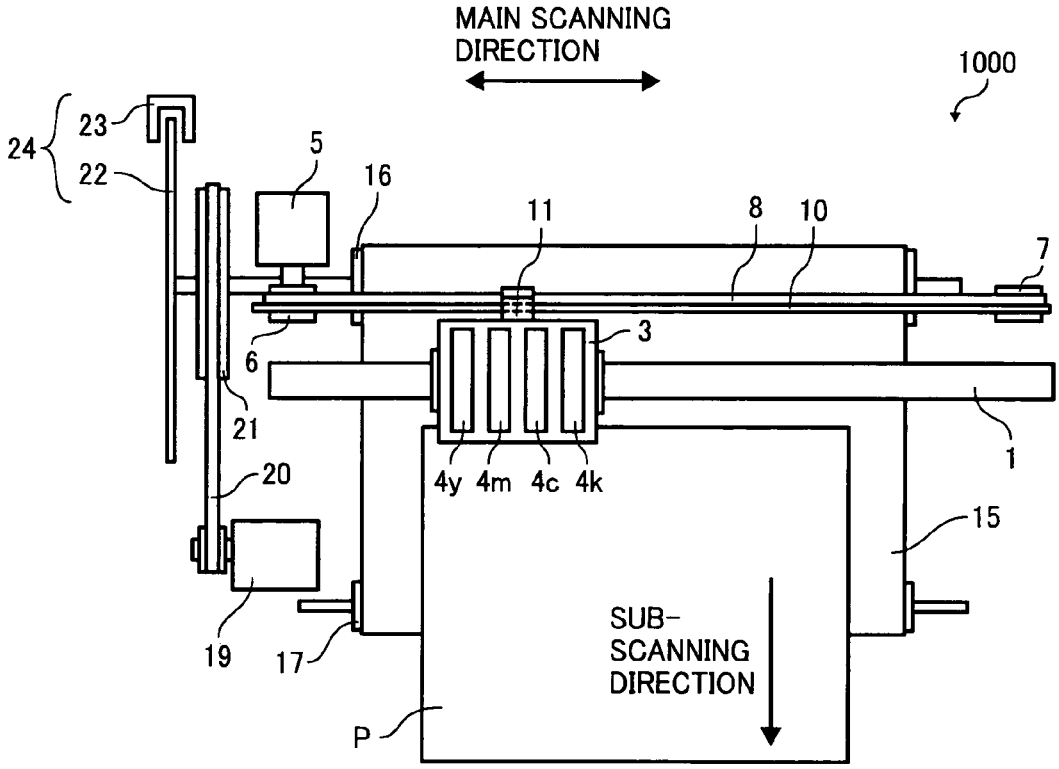
FIG. 1 is a plan view of an ink-jet recording apparatus.
Figure 2:
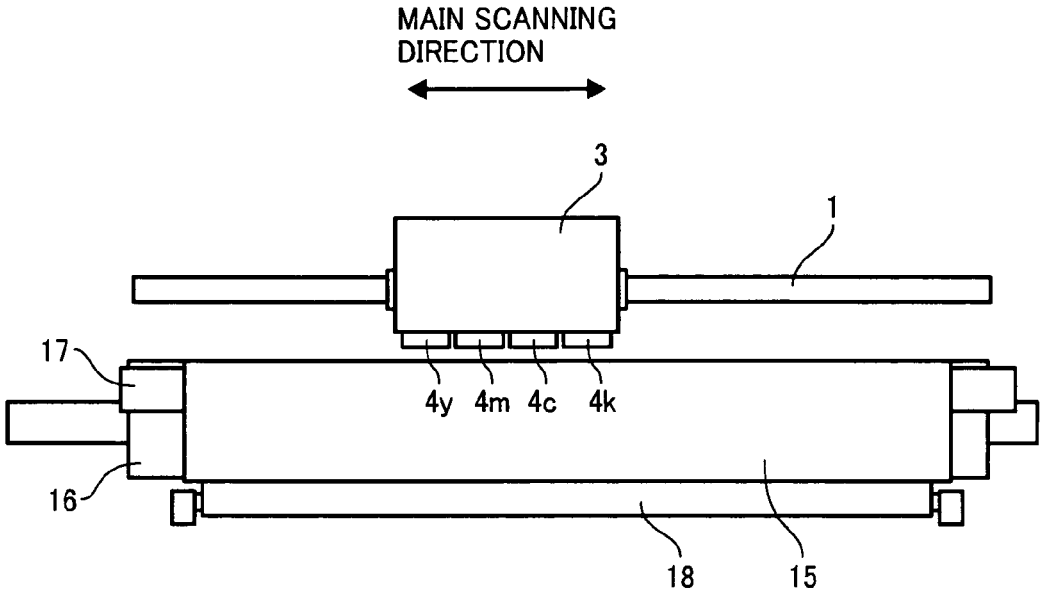
FIG. 2 is a front view of the ink-jet recording apparatus.
Figure 3:
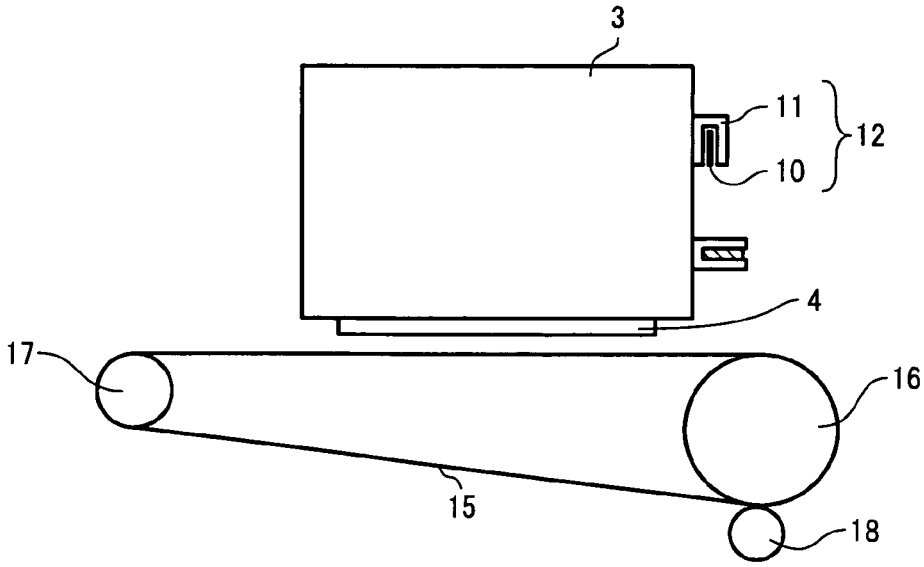
FIG. 3 is a side view of the ink-jet recording apparatus.

An ink-jet recording apparatus 1000 is explained with reference to FIGS. 1 to 3 as an image forming apparatus according to the present invention. FIG. 1 is a plan view of the ink-jet recording apparatus 1000, FIG. 2 is a front view of the ink-jet recording apparatus 1000, and FIG. 3 is a side view of the ink-jet recording apparatus 1000.

In the ink-jet recording apparatus 1000, a carriage 3 is supported on a guide rod 1 placed laterally between left and right side boards (not shown), and is moved for scanning in a main scanning direction by a main scanning motor 5 via a timing belt 8 supported by a drive pulley 6 and a driven pulley 7.

The carriage 3 includes recording heads 4*y*, 4*m*, 4*c*, and 4*k* (called "recording head 4" when no color distinction is made) having four liquid ejection heads that eject, for example, ink droplets having colors of yellow (Y), cyan (C), magenta (M), and black (K), with nozzle arrays forming a plurality of ink ejection ports (nozzles) on a nozzle face being arranged in the direction perpendicular to the main scanning direction (sub scanning direction) to direct the ink ejection ports downward. Each liquid ejection head is independent in color; however one or a plurality of heads having a plurality of nozzle arrays ejecting recording liquid (ink) droplets of each color can be provided. The number and arrangement of colors is not limited to the above case.

The liquid ejection head as the recording head 4 can include a pressure generating unit for generating pressure for ejecting droplets, such as a piezoelectric actuator made of a piezoelectric element or the like, a thermal actuator using such a heat-generating resistance as electricity-heat converting element to utilize phase change due to film boiling of a liquid, a shape-memory alloy actuator utilizing metal phase change due to temperature change, or an electrostatic actuator utilizing electrostatic force.

A linear encoder 12 includes an encoder scale 10 and an encoder sensor 11, and detects the position and speed of the carriage 3 in the main scanning direction. The encoder scale 10 has slits that can be black and white marks, and is arranged along the main scanning direction on the back of the carriage 3, and an encoder sensor 11 is arranged on the carriage 3 and detects the slits of the encoder scale 10.

The ink-jet recording apparatus 1000 includes a conveying belt 15, which is a conveying unit that attracts a sheet P thereto by an electrostatic force to convey the sheet P at the position opposite to the recording head 4. The conveying belt 15 is an endless belt that is supported by a conveying roller 16 and a tension roller 17 to extend between both rollers, and that moves in a belt conveying direction (sub scanning direction). While moving, the conveying belt 15 is charged (given electric charges) by a charging roller 18.

The conveying belt 15 has a single-layer structure or a multilayer (two layers or more) structure. When the conveying belt 15 is a single-layer conveying belt, the entire layer is made of an insulating material because the belt comes in direct contact with the sheet and the charging roller 18. When the conveying belt 15 is a multilayer conveying belt 15, the side coming in contact with the sheet and the charging roller 18 is preferably made of an insulating layer, and the side not coming in contact with the sheet and the charging roller 18 is preferably made of a conductive layer.

The conveying belt 15 moves as a sub scanning motor 19 rotates the conveying roller 16 via a drive belt 20 and a timing roller 21. A wheel encoder 24 includes an encoder wheel 22 and an encoder sensor (transmission type photosensor) 23. The encoder wheel 22 having slits is fitted to the shaft of the conveying roller 16, and the encoder sensor 23 detects the slits of the encoder wheel 22.

Figure 4:
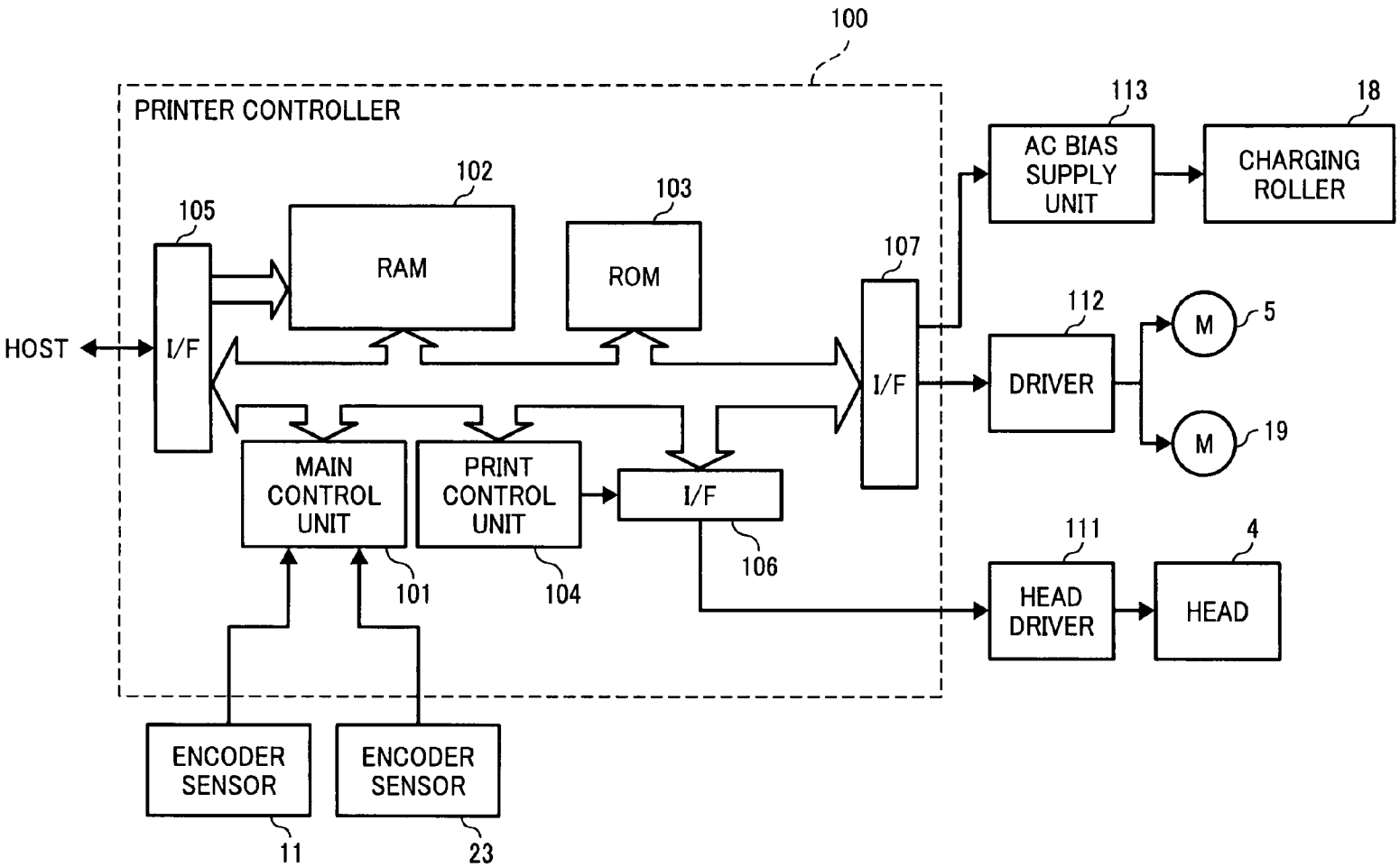
FIG. 4 is a functional block diagram of a control unit of the ink-jet recording apparatus.

The control unit of the ink-jet recording apparatus 1000 is explained referring to FIG. 4. The control unit includes a printer controller 100 that controls the whole ink-jet recording apparatus 1000, and includes a main control unit 101 including a central processing unit (CPU), a read only memory (ROM), a random access memory (RAM), and the like, a RAM 102, a ROM 103, a print control unit 104, a host I/F 105, and I/Fs 106 and 107, a head driver 111 that drives the recording head 4, a driver 112 that drives the main scanning motor 5 and the sub scanning motor 19, and an alternating current (AC) bias supply unit 113 that applies an AC bias voltage to the charging roller 18. The main control unit 101 receives input of a detection signal from the encoder sensor 11 of the linear encoder 12 for detecting the position and speed of the carriage 3 and from the encoder sensor 23 of the wheel encoder 24 for detecting the position and speed of the conveying belt 15.

Through the I/F 105 of the printer controller 100, print data from a host device such an information processor (e.g., a personal computer (PC)), an image reading device (e.g., an image scanner), and an image-capturing device (e.g., a digital camera) is received via a cable or a network. The RAM 102 is used as various buffers, work memories, or the like, and stores therein various data. The ROM 103 stores therein various control routines executed by the main control unit 101, font data, graphic functions, and various procedures. The print control unit 104 includes a drive signal generating circuit for generating a drive waveform for the recording head 4, and sends print data developed into dot pattern data (bitmap data), drive waveform, and the like to the head driver 111 via the I/F 106.

The main control unit 101 detects the speed and position of the carriage 3 in the main scanning direction based on a detection signal from the encoder sensor 11 to control the carriage 3 to stop its movement, and also controls the conveying belt 15 to stop its movement based on a detection signal from the encoder sensor 23.

The main control unit 101 reads out print data from a reception buffer contained in the I/F 105 to analyze the read data, stores an analysis result (intermediate code data) in a given area in the RAM 102, generates dot pattern data for outputting an image in use of font data stored in the ROM 103 from the stored analysis result, and stores the dot pattern data on another given area in the RAM 102. When image data is developed into bitmap data by a printer driver at the host device side to transmit the bitmap data to the recording apparatus, the main control unit 101 just stores the received bitmap image data in the RAM 102.

After obtaining dot pattern data equivalent to one line made by the recording head 4, the main control unit 101 sends the dot pattern data equivalent to one line in the form of serial data to the head driver 111 via the I/F 106 in synchronization with a clock signal from an oscillation circuit, and also sends a latch signal to the head driver 111 in given timing.

Figure 5:
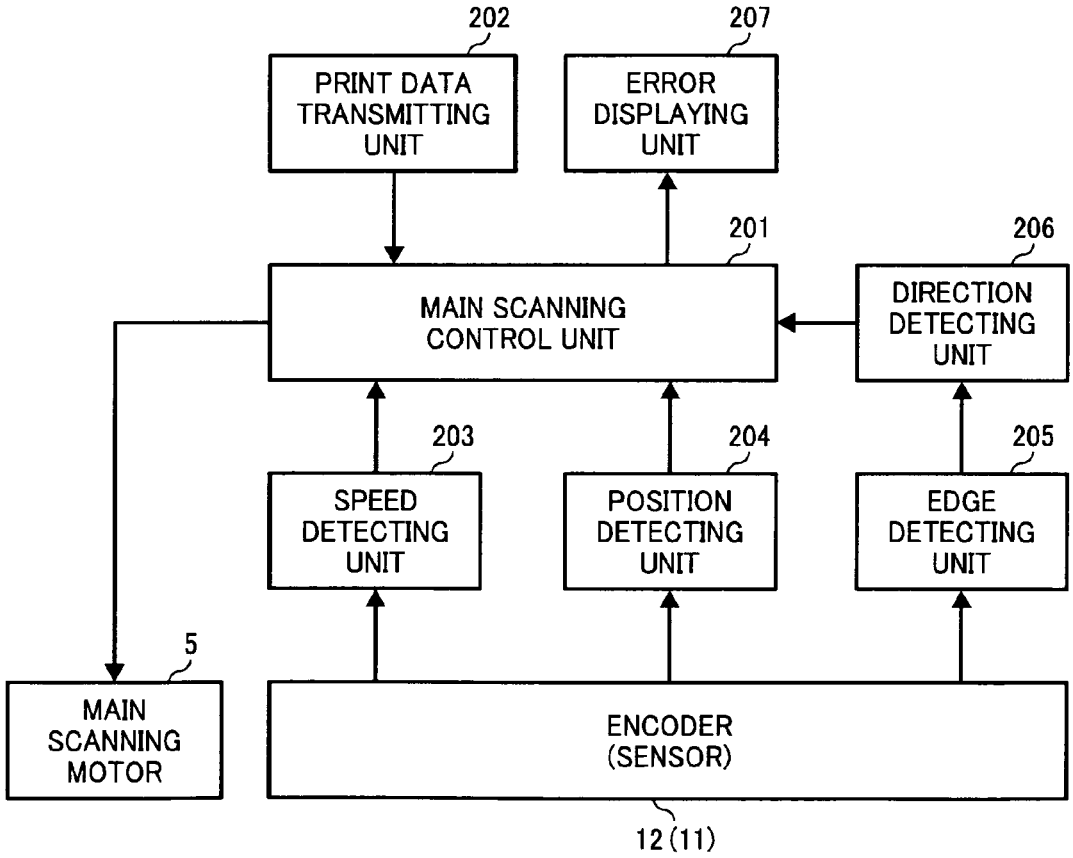
FIG. 5 is a functional block diagram of a portion for drive control for a main scanning motor of the ink-jet recording apparatus.

The detail of the part of the control unit that is related to drive control over the main scanning motor is explained referring to a functional block diagram of FIG. 5.

A main scanning control unit 201 sets the moving speed, moving position, moving direction, and the like of the carriage 3 based on print data transmitted from a print data transmitting unit 202, and drives and controls the main scanning motor 5. A speed detecting unit 203 detects the moving speed of the carriage 3 (carriage speed) based on a detection signal (also called reading signal or detection pulse) obtained from the encoder sensor 11 of the linear encoder 12. A position detecting unit 204 detects the position of the carriage 3 (carriage position) based on a signal obtained from the encoder sensor 11 of the linear encoder 12. An edge detecting unit 205 detects an edge of a signal obtained from the linear encoder 12.

A direction detecting unit 206 detects the moving direction of the carriage 3 based on a state table shown in FIG. 9 by using edge information obtained from the edge detecting unit 205.

The main scanning control unit 201 carries out feed back control on the main scanning motor 5 based on information obtained from the speed detecting unit 203, the position detecting unit 204, the edge detecting unit 205, and the direction detecting unit 206. In a first embodiment of the present invention, when the direction detecting unit 206 detects a change in the moving direction of the carriage 3 while the carriage 3 is moving at a constant speed, the main scanning control unit 201 determines that dirt is present on the encoder scale 10, which is regarded as error detection. In a second embodiment of the present invention, when the direction detecting unit 206 detects a change in the moving direction of the carriage 3 before the carriage 3 reaches a preset moving direction change position for the carriage 3, the main scanning control unit 201 determines that dirt is present on the encoder scale 10, which is regarded as error detection.

When the main scanning control unit 201 detects an error during main scanning control, the main scanning control unit 201 notifies an error displaying unit 207 of the occurrence of the error, and the error displaying unit 207 displays the error occurrence.

Figure 6:
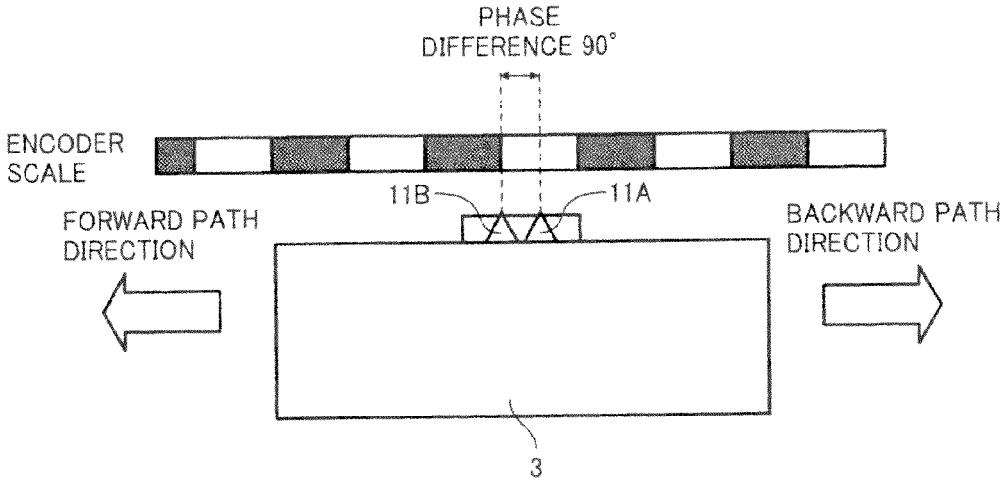
FIG. 6 is a schematic diagram for explaining a relation between an encoder sensor and a carriage.
Figure 7:
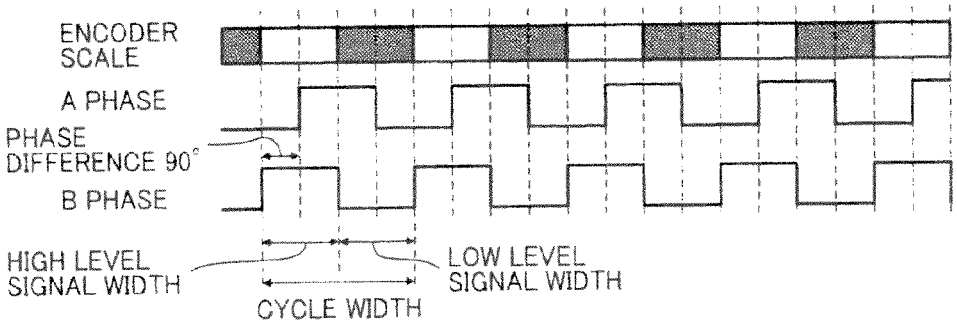
FIG. 7 is a schematic diagram for explaining a reading signal from a linear encoder when a carriage moves in a forward path direction.
Figure 8:
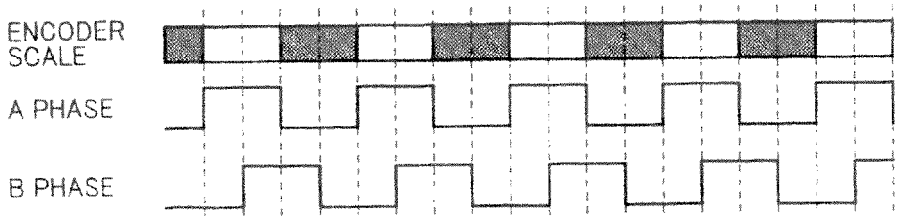
FIG. 8 is a schematic diagram for explaining a reading signal from the linear encoder when the carriage moves in a backward path direction.

A reading signal from the linear encoder 12 and detection of the moving direction of the carriage 3 are explained referring to FIGS. 6 to 9. FIG. 6 is a schematic diagram of the encoder scale 10 and the encoder sensor 11, FIG. 7 is a schematic diagram for explaining an encoder reading signal when the carriage 3 moves in a forward direction, FIG. 8 is a schematic diagram for explaining an encoder reading signal when the carriage 3 moves in a backward direction, and FIG. 9 is a table for explaining the state transition of an A phase and a B phase and a carriage moving direction.

The encoder sensor 11 arranged on the carriage 3 includes two photosensors of an encoder sensor 11A (for A phase) and an encoder sensor 11B (for phase B), which are arranged to be shifted to each other in phase by 90 degrees.

An encoder reading signal output from the encoder sensor 11 is, therefore, a two-phase signal having an A phase and a B phase (phase difference of 90 degrees) that are detected by two encoder sensors 11A and 11B, where an optically bright portion of the encoder scale 10 is defined as high level "H" and an optically dark portion of the same is defined as low level "L". The bright portion can be defined as low level "L", and the dark portion can be defined as high level "H" in use of an inverter circuit.

Detection of the moving direction (scanning direction) of the carriage 3 based on output (reading signal) from the encoder sensor 11 is explained.

When the above two-phase encoder reading signal is expressed as a two-bit signal ("1" represent the high level, and "0" represents the low level), the moving direction of the carriage 3 can be determined from changeover edges where state transition occurs. For example, when the state transition of the encoder reading signal (expressed as "A phase and B phase") is "00→01→11→10→00", the movement of the carriage 3 is defined as a normal forward movement (FIG. 7), and when the state transition is "00→10→11→01→00", the movement of the carriage 3 is defined as a normal backward movement (FIG. 8). As a result, as shown in FIG. 9, whether the moving direction of the carriage 3 is the forward direction or the backward direction can be determined based on the state transition of the A phase and B phase.

An encoder reading signal in the case where dirt is adhered to the encoder scale 10 is explained with reference to FIG. 10.

FIG. 10 is a schematic diagram representing an encoder reading signal when the carriage 3 is moving in the forward direction. When dirt 250 is adhered to the encoder scale 10, the encoder sensor 11 may detect the dirt 250. This may cause the B phase, which is supposed to be in "H" state, to change into "L" state because of detection of the front end of the dirt 250. As a result, a change in the moving direction of the carriage 3 to the backward direction is detected despite of the fact that the carriage 3 actually moves in the forward direction, which is determined from the relation between the state transition of the A phase and B phase and the carriage moving direction shown in FIG. 9.

Likewise, detection of the rear end of the dirt 250 by the B phase signal may cause a state transition from "L" state to "H" state at a spot where the state transition is not supposed to occur. This case leads to detection of a change in the moving direction of the carriage 3 to the backward direction.

The above explanation is made on a case where the carriage 3 is moved in the forward direction in a state where the dirt is adhered to the encoder scale 10. For the same reason as in this case, when dirt is detected erroneously while the carriage 3 is moving in the backward direction, a change in the moving direction of the carriage 3 is detected as the change to the forward direction.

A method of calculating the position of the carriage is explained referring to FIG. 11.

Current position information of the carriage 3 is obtained by a process of setting the absolute position of the carriage 3 from an encoder reading signal, adding one to the value of absolute position when a rising edge of the A phase is detected as the carriage 3 is moving in the forward direction, and subtracting one from the value of absolute position when a falling edge of the A phase is detected as the carriage 3 is moving in the backward direction.

Figure 12:
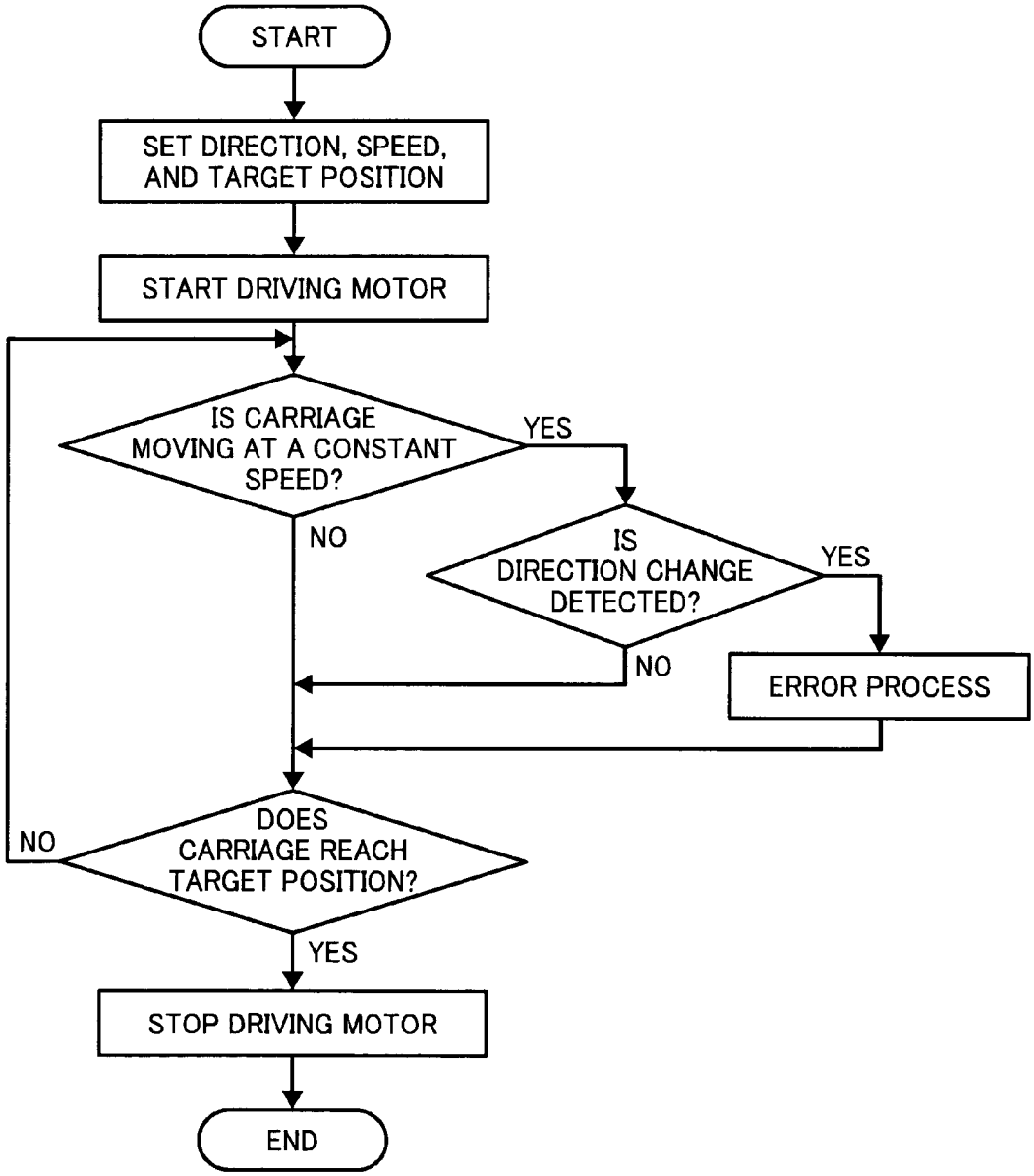
FIG. 12 is a flowchart of a procedure for detecting dirt on a linear scale according to a first embodiment of the present invention.

An operation of the first embodiment is explained with reference to a flowchart of FIG. 12, in which dirt on the encoder scale is detected by detecting a direction change during the movement of the carriage 3 at a constant speed.

The main scanning control unit 201 sets a moving direction, a speed, and a target position based on print data transmitted from the print data transmitting unit 202, and starts driving the main scanning motor 5. Then, the main scanning control unit 201 determines whether the main scanning motor 5 is operating for moving the carriage 3 at a constant speed. When the carriage 3 is moving at a constant speed, the main scanning control unit 201 determines whether the direction detecting unit 206 detects a change in the moving direction of the carriage 3. When the change in the moving direction is detected, that is, when the change in the moving direction of the carriage 3 is detected while the carriage 3 is moving at a constant speed, the main scanning control unit 201 determines that dirt is present on the encoder scale 10 and executes an error process.

In the error process, information about the occurrence of dirt on the encoder and the position of the dirt is displayed on the error displaying unit 207 right after the occurrence of the error.

The information about the occurrence of the dirt on the encoder and the position of the dirt can be temporarily stored on a memory right after the occurrence of the error, and then be displayed on the error displaying unit 207 after completion of a print operation. Displaying the above information after completion of printing allows collective display of the positions of dirt when the dirt is formed on a plurality of spots on the encoder scale 10. This facilitates confirmation of a dirt position.

In executing printing following dirt detection, all print jobs can be executed to the end in a mode that gives priority to speed, and a job on execution can be cancelled in a mode that gives priority to image quality. As a result, unnecessary printing is not executed in the image quality priority mode when image quality is not guaranteed due to dirt on the encoder scale.

Determination on whether the carriage 3 is on move at a constant speed can be made based on speed information obtained from the speed detecting unit 203 of FIG. 5. Alternatively, it is also possible to set an area in which the carriage 3 moves at a constant speed in advance, and determines whether the carriage 3 is in the area based on position information obtained from the position detecting unit 204 of FIG. 5.

In the above manner, it is determined that dirt is presents on the linear scale when a change in the moving direction of the moving member is detected while the moving member is moving at a constant speed. As a result, the dirt on the linear scale can be detected in a simple configuration, and the dirt can be detected even during normal print operation without providing dirt detection mode that is required by a conventional technique.

Figure 13:
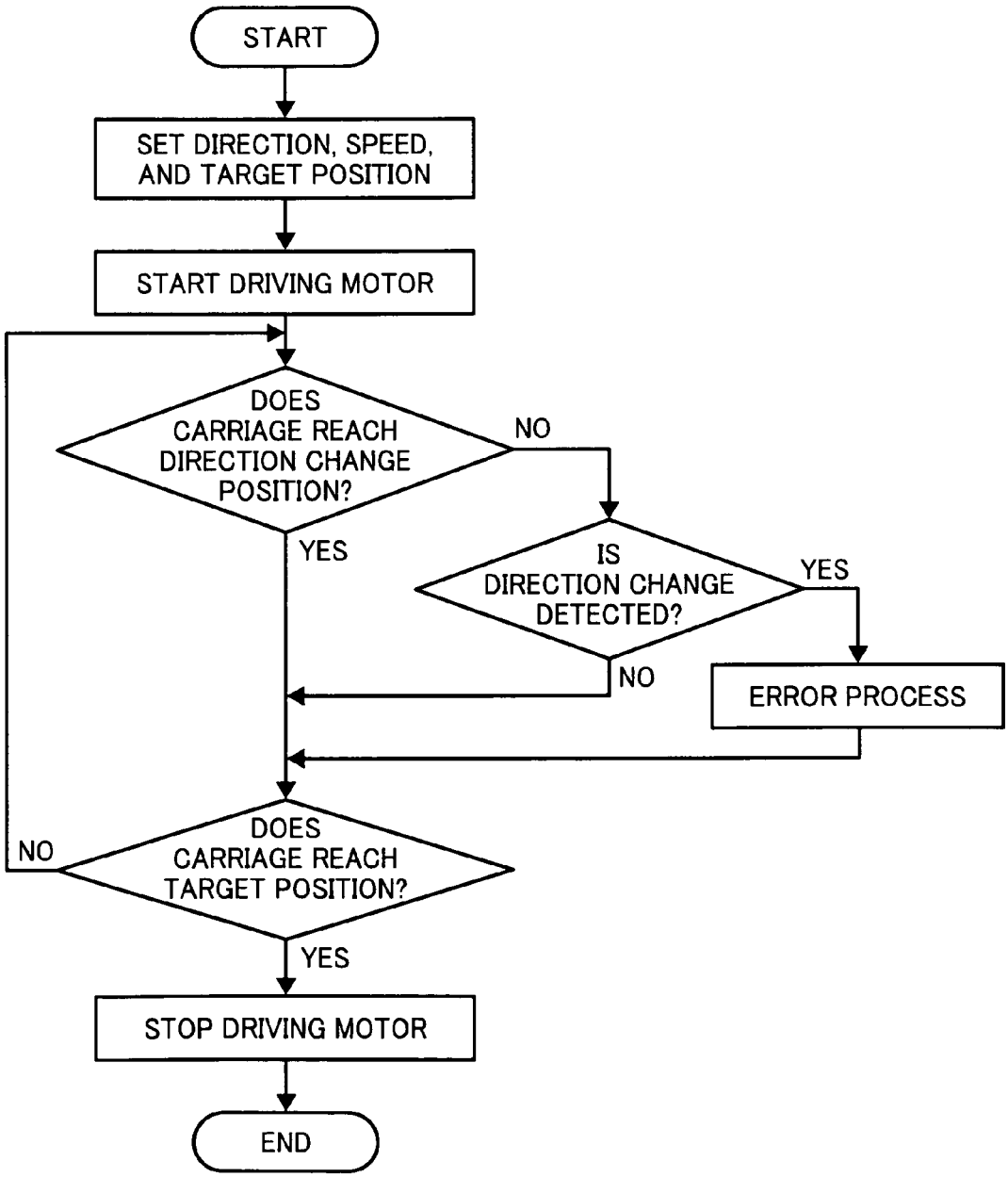
FIG. 13 is a flowchart of a procedure for detecting dirt on a linear scale according to a second embodiment of the present invention.

An operation of the second embodiment is explained with reference to a flowchart of FIG. 13, in which dirt on the encoder scale 10 is detected by detecting a direction change before the carriage 3 reaches a preset moving direction change position.

The main scanning control unit 201 sets a moving direction, a speed, and a target position based on print data transmitted from the print data transmitting unit 202, and starts driving the main scanning motor 5. Then, the main scanning control unit 201 determines whether the position of the carriage 3 matches the preset moving direction change position. When the carriage 3 does not reach the moving direction change position yet, the main scanning control unit 201 determines whether the direction detecting unit 206 detects a change in the moving direction of the carriage 3. When the change in the moving direction is detected, that is, the change in the moving direction is detected before the carriage 3 reaches the preset moving direction change position, the main scanning control unit 201 determines that dirt is present on the encoder scale 10 and executes the error process.

The direction change position can be calculated from print data. For example, when forward path printing is carried out in bidirectional printing, a print end position for the forward path printing and a print start position for backward path printing following the forward path printing are calculated based on the print data. When the print start position for the backward path printing is closer to the exterior of the recording apparatus than the print end position, the carriage is moved to the print start position for the backward path printing when print operation along the forward path is carried out. When the print end position for the forward path printing is closer to the exterior of the recording apparatus, on the other hand, the carriage is moved to the print end position for the forward path printing. On the backward path, the carriage is moved in a direction opposite to the direction of forward path printing from the position where the forward movement of the carriage ends. This means that the position where the forward movement completes corresponds to the direction change position. Likewise, in the backward path printing, the position where the backward movement of the carriage completes corresponds to the direction change position. In a unidirectional printing, following the end of the carriage movement for printing, the carriage is moved in a direction opposite to the movement for printing to the next print start position.

When the carriage is moved to the next print start position, the direction of move is changed and the carriage is moved for printing. Thus, the position where the carriage ends the movement from the print move end position to the print start position ends represents the direction change position.

When the main scanning motor 5 is stopped, however, the stoppage position of the carriage 3 includes a margin of error. The above direction change position is, therefore, determined in consideration of this error.

The above explanation is made on a case where a direction change is detected before the carriage on move at a constant speed reaches the direction change position. In addition to the above case, the presence of dirt on the encoder scale can be determined when a direction change is detected in a time during which the direction change is not supposed to occur, for example, during printing.

In the above manner, the presence of dirt on the linear scale is determined when a change in the moving direction of the moving member is detected before the moving member reaches the preset moving direction change position. As a result, dirt on the linear scale can be detected in a simple configuration, and the dirt can be detected even during normal print operation without providing dirt detection mode that is required in a conventional technique.

A third embodiment of the present invention is explained with reference to FIGS. 14 to 26.

Figure 14:
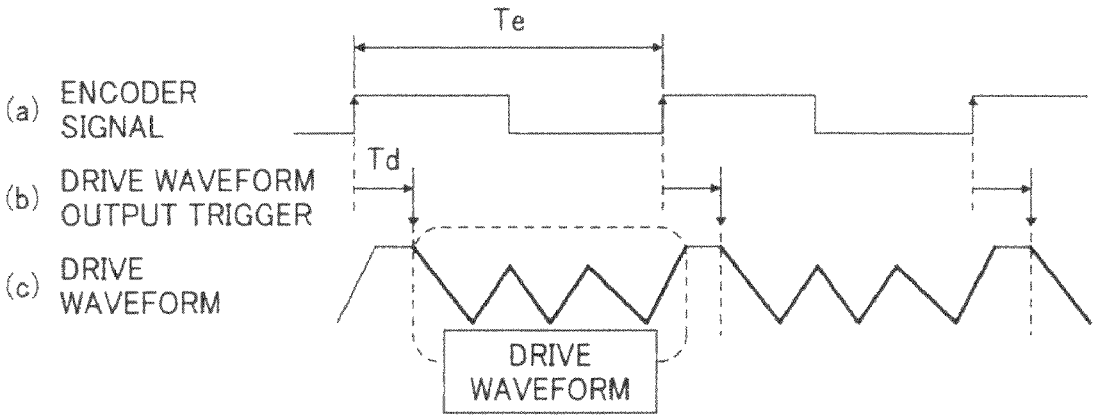
FIG. 14 is a timing chart for explaining an encoder reading signal and drive waveform output.

Determination of print timing and output of a drive waveform are explained with reference to FIG. 14. The print timing is determined using a rising edge of an encoder signal indicated by (a) in FIG. 14 (A phase or B phase of the encoder reading signal) as a reference. At the point that a given delay time Td has passed from the determined print timing as indicated by (b) in FIG. 14, a drive waveform output trigger is generated, which triggers output of a drive waveform that is a signal causing the recording head 4 to print. The drive waveform is thus output as indicated by (c) in FIG. 14. The delay time Td is set for ink-landing position adjustment in bidirectional printing.

When the carriage 3 is moving at a constant speed, an encoder signal rising edge arises at every constant edge interval time Te under an ideal condition.

Figure 15:
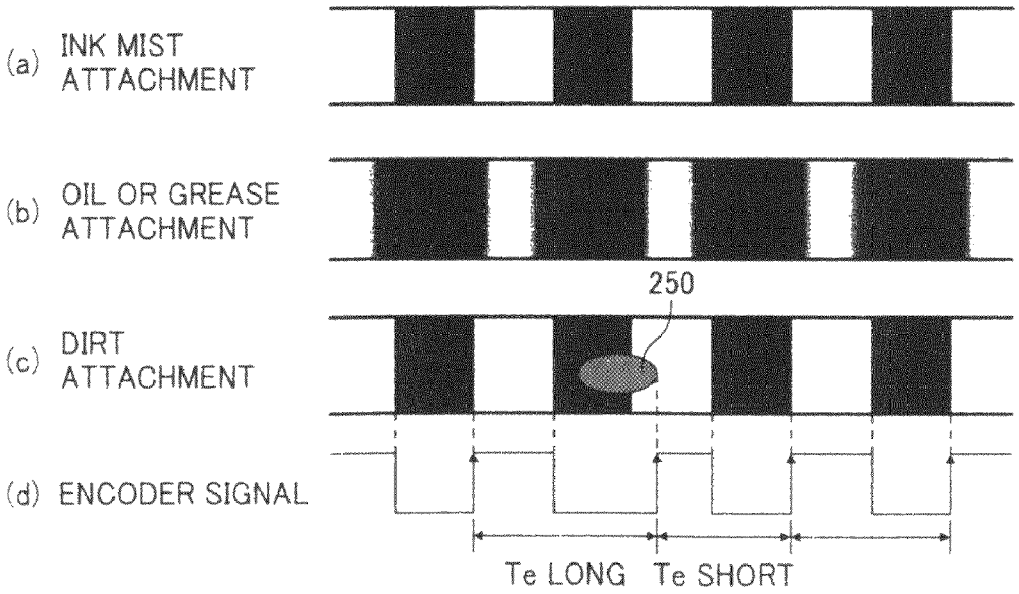
FIG. 15 is a schematic diagram for explaining an increase/decrease in edges of the encoder reading signal due to dirt on the linear scale.

However, when ink mist adheres to the encoder scale 10 as indicated by (a) in FIG. 15, or oil, grease, or the like applied to the guide rod 1 or the like adheres to the encoder scale 10 as indicated by (b) in FIG. 15, or other dirt adheres to the encoder scale 10 as indicated by (c) in FIG. 15, the boundary between the bright portion and the dark portion of the encoder scale 10 becomes obscure, which leads to arising of the rising edge in timing different from the original timing corresponding to the boundary. This gap in edge arising timing results in an increase/decrease in (elongation/shortening of) the edge interval time Te as indicated by (d) in FIG. 15.

Figure 16:
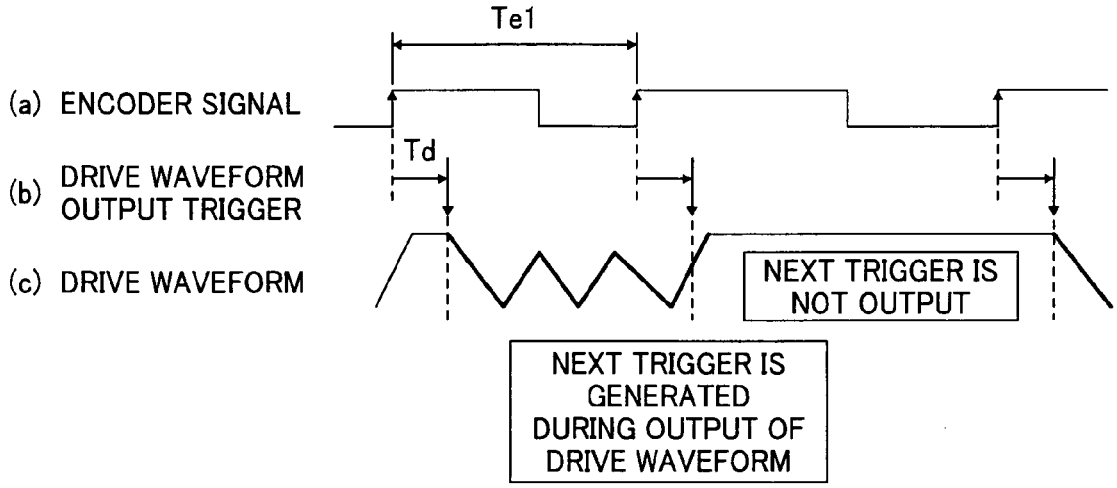
FIG. 16 is a timing chart for explaining a case in which the next drive waveform output trigger is generated during output of a drive waveform.

In the recording apparatus, when the edge interval time becomes a time interval Te1 that is shorter than the original time interval Te as indicated by (a) in FIG. 16, a drive waveform output trigger is generated as indicated by (b) in FIG. 16. However, when the next drive waveform output trigger is generated during the generation of a drive waveform as indicated by (c) in FIG. 16, the next drive waveform is not output, so that ink is not ejected (no printing).

Figure 17:
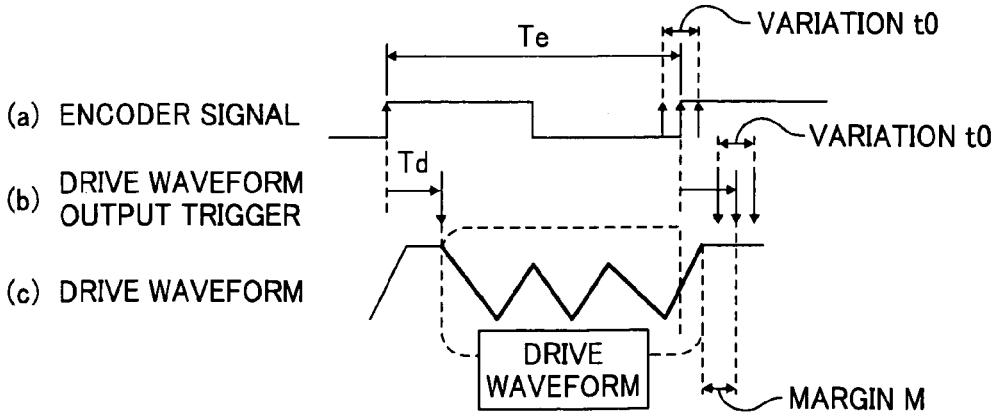
FIG. 17 is a timing chart for explaining an edge interval of the encoder reading signal and a margin of an output time of the drive waveform.

In the recording apparatus, therefore, a margin M is given to the output time of a drive waveform as indicated by (c) in FIG. 17, so that the next drive waveform output trigger is not generated during the generation of the drive waveform as indicated by (b) in FIG. 17 even if a variation t0 is formed in the edge interval time Te because of the assumed dirt of the encoder scale 10 as indicated by (a) in FIG. 17.

Thus, for the time interval Te of print timing corresponding to the edge interval time Te of the encoder signal, the margin M of the output time of the drive waveform (signal causing the recording head to print) is changed to be smaller than the margin M for ordinary image formation, and printing (image formation) is carried out. Because printing is not carried out at a portion where dirt is present on the encoder scale, a dirt adhering portion on the encoder scale 10 can be identified from the result of the printing.

Figure 18:
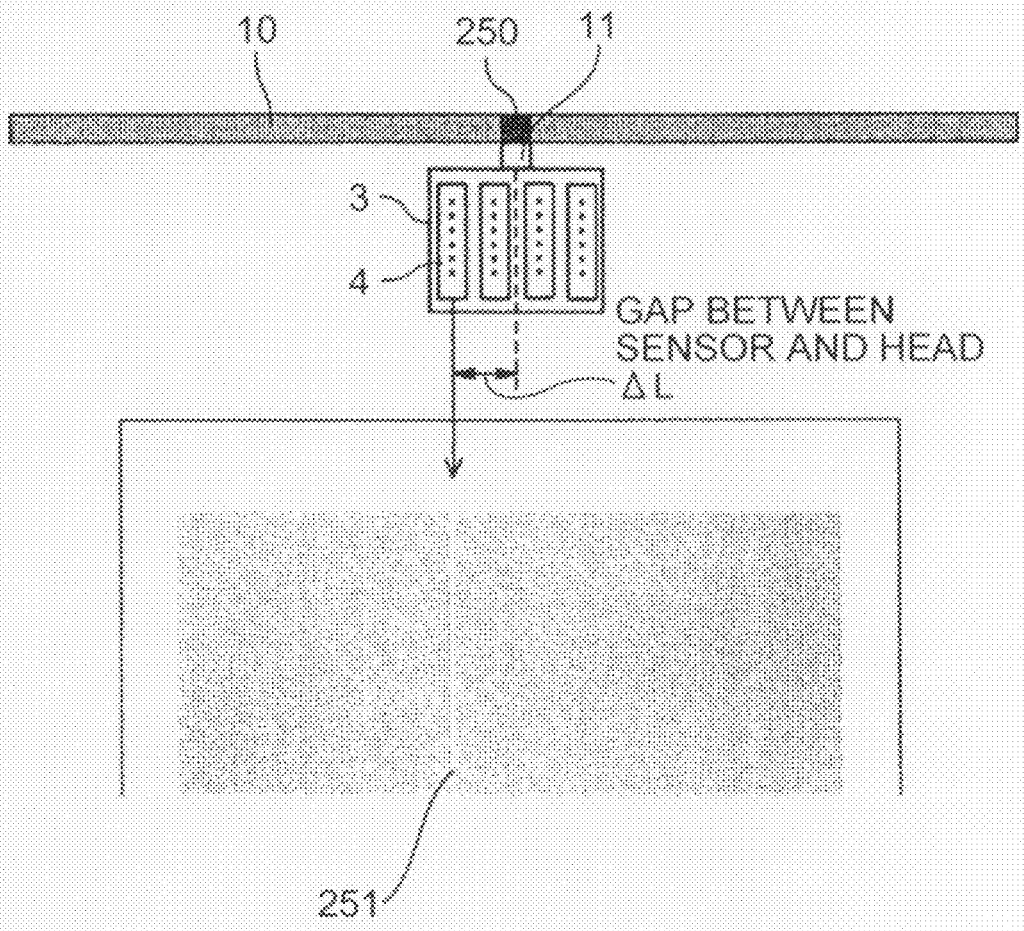
FIG. 18 is a schematic diagram of an example of an output result of an image for detecting dirt on the encoder according to a third embodiment of the present invention.

For example, as shown in FIG. 18, by printing a chart (image for detecting dirt on the encoder) which is obtained by painting the sheet surface in a single color in a state where the margin M is small, it is possible to determine that dirt is present on a nonprinted portion 251. When the recoding head 4 for ejecting ink and the encoder sensor 11 are shifted in position to each other in the main scanning direction, however, a positional gap ΔL equivalent to the shift between the recoding head 4 and the encoder sensor 11 is caused between the dirt adhering portion of the encoder scale 10 and the nonprinted portion. This positional gap needs to be notified to the user. For example, the positional gap is printed on the chart, displayed on a personal computer at the host side, or displayed on a display unit of a printer (image forming apparatus).

Figure 19:
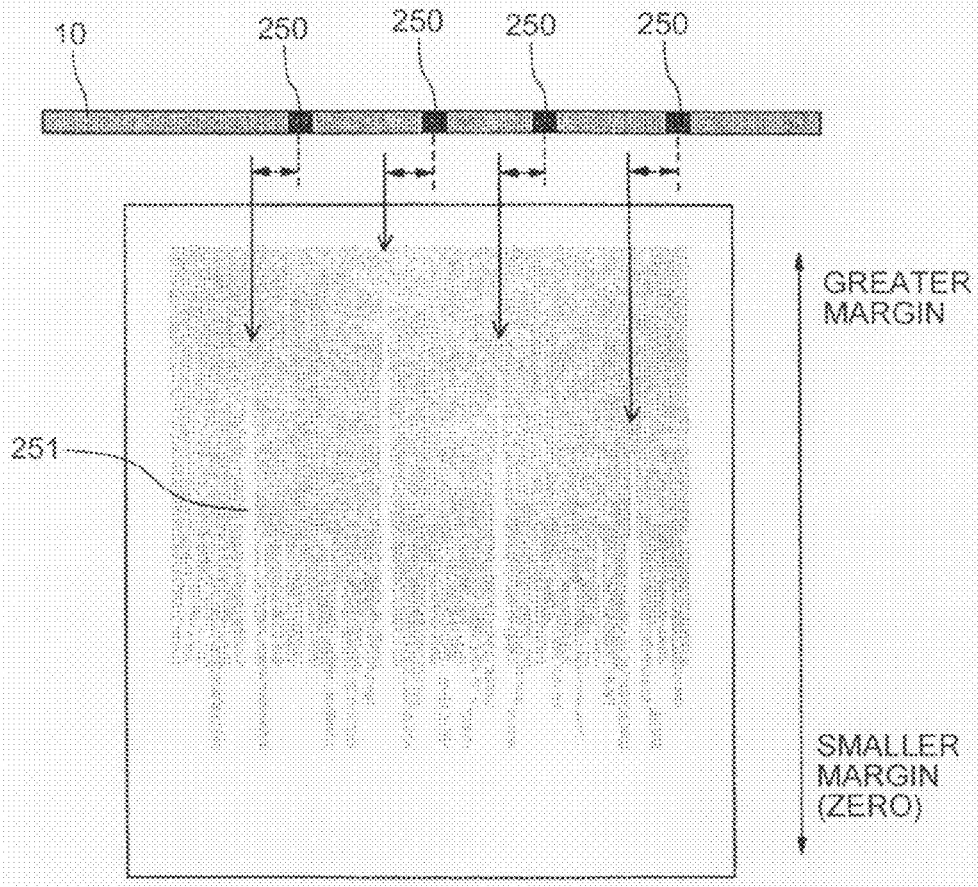
FIG. 19 is a schematic diagram of another example of an output result of the image for detecting the dirt of the encoder.

When printing is carried out while the margin M is enlarged or reduced, the degree of the effect of dirt on printing can be checked. Specifically, as shown in FIG. 19, a chart in a single color is printed so that the margin M gets smaller at a given interval for every scanning. As a result, nonprinted portions appear in the order of dirt having a greater effect on the edge interval time Te (in FIG. 19, a blank formed on the upper part of a print result indicates a greater effect of dirt).

While the image for detecting dirt on the encoder is defined as a "chart painted in a single color" in the above explanation, more specifically, the image is preferably a "chart drawn by nozzles included in a line on the same straight line extending in the sub scanning direction". Therefore, an array of nozzles having the same position relation with the encoder sensor 11 is used relative to the main scanning direction, so that the position relation between the dirt adhering portion and the nonprinted portion becomes constant. This facilitates identification of the dirt adhering portion. When nozzles on the same line are used, therefore, even a chart using a plurality colors is preferable. Contrary to that, a chart painted in a single color but using nozzles on different lines is not preferable, although it is permissible.

Figure 20:
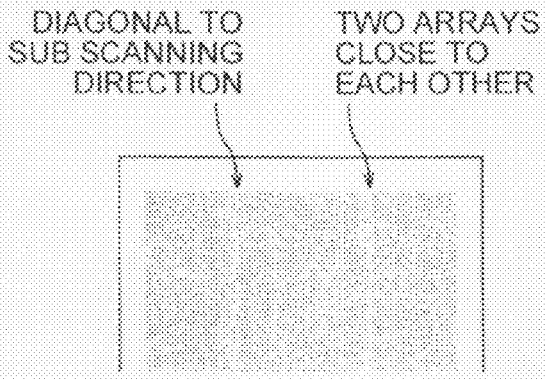
FIG. 20 is a schematic diagram for explaining a nozzle array to be used.

In a range where the nonprinted portion is observed to be virtually straight, use of a nozzle array not exactly on the straight line in the sub scanning direction is permissible. For example, a nozzle array diagonal to the sub scanning direction or two nozzle arrays close to each other can be used as shown in FIG. 20.

While any nozzle array can be used to print a chart as the image for detecting dirt on the encoder, using a nozzle array close to the encoder sensor 11 relative to the main scanning direction, for example, two arrays at the center of the recording head 4 as shown in FIG. 18 causes less position gap between the dirt portion and the nonprinted portion. This facilitates a user or a worker in identifying the dirt position from an output chart drawn by using such nozzles.

Figure 21:
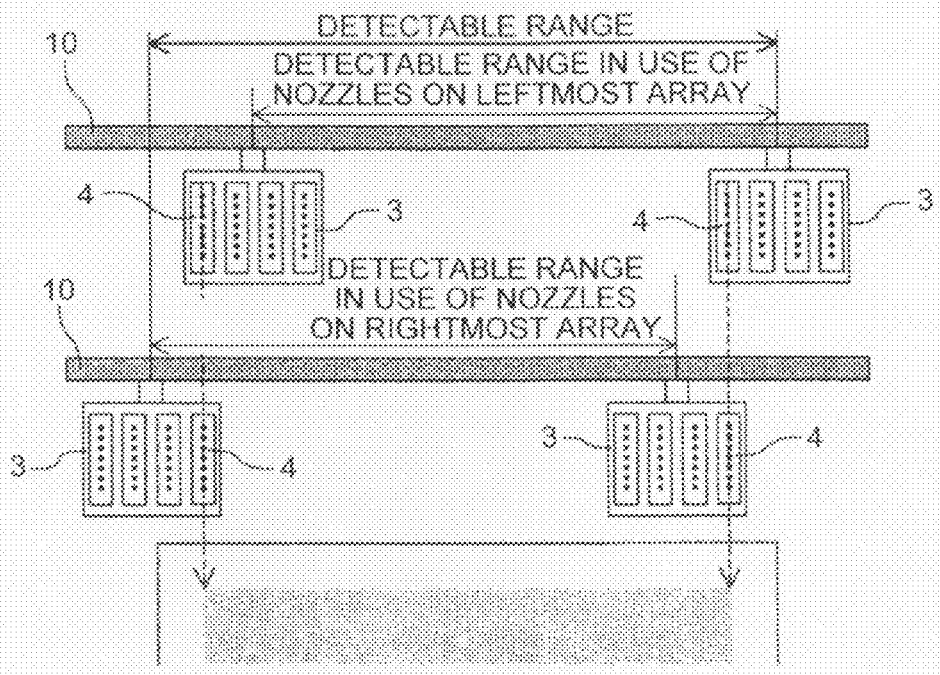
FIG. 21 a schematic diagram for explaining one example of a nozzle array to be used and a detectable range.
Figure 22:
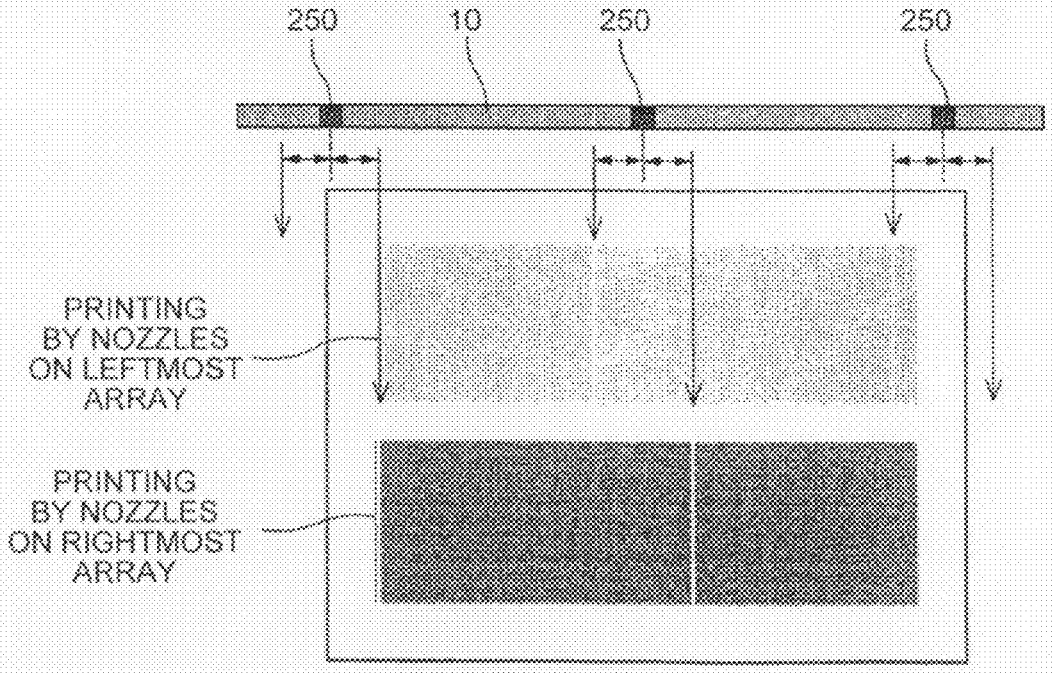
FIG. 22 a schematic diagram for explaining another example of a nozzle array to be used and a detectable range.

Conversely, outputting a chart using each of the outermost nozzle arrays of the recording head 4 extends a range on the encoder scale 10 where the dirt adhering portion can be detected as shown in FIGS. 21 and 22. At this time, if the range of the chart is given the printable maximum width in the main scanning direction, the entire printable range of the ink-jet recording apparatus 1000 can be detected. This allows detection of all dirt adhering portions that affect a print result. FIG. 21 represents a case where a chart for detecting dirt on the encoder scale 10 is output using the leftmost and rightmost nozzle arrays of the recording head 4, and FIG. 22 represents an example of a chart that is output, using the leftmost and rightmost nozzle arrays, to detect dirt on the encoder scale 10.

In the present embodiment, a unit for checking a dirt position on the encoder scale 10 is provided in various manners. The unit can be such that only a user can check the dirt position from a print result. Alternatively, a unit for detecting an abnormality of generation of the next drive waveform output trigger before the end of output of a drive waveform can be provided in the ink-jet recording apparatus 1000 so that the apparatus itself can check the dirt position, and another unit can notify a user of the dirt position.

In the above manner, in detecting dirt on the linear scale, the ratio of the output time of a signal causing the recording head to print (drive waveform) to the time interval from the print timing is changed to be different from the ratio for normal image formation, and the image for dirt detection is formed. This allows identification and detection of the dirt on the linear scale in a simple configuration.

Examples of reducing the margin M of the output time of a drive waveform are explained with reference to FIGS. 23 to 25.

Figure 23:
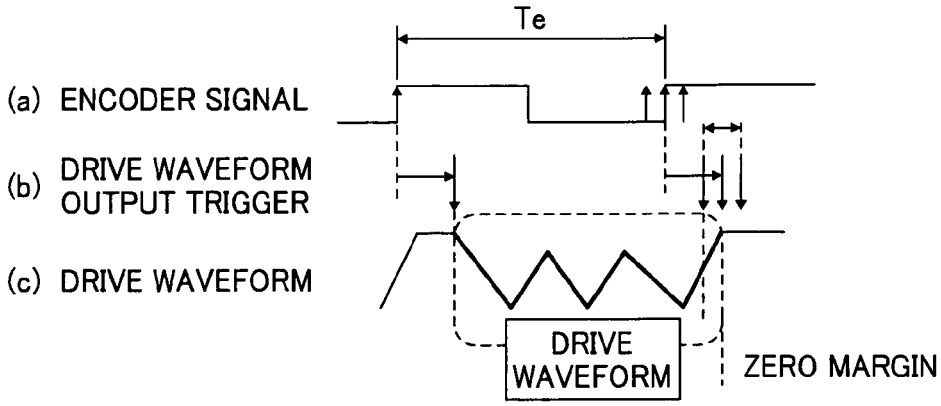
FIG. 23 is a timing chart for explaining a first example of ratio change.

In a first example shown in FIG. 23, the moving speed of the carriage 3 is changed to be higher than the speed for normal image formation to shorten the edge interval time Te of an encoder signal, so that the output time of a drive waveform becomes relatively longer in relation to the shortened edge interval time, thereby making the margin M zero.

Figure 24:
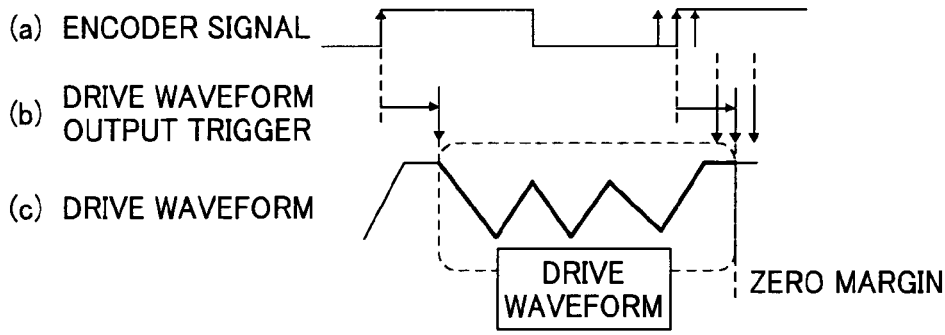
FIG. 24 is a timing chart for explaining a second example of ratio change.

In a second example shown in FIG. 24, the output time of a drive waveform is changed to be longer than the output time for normal image formation, thereby making the margin M zero.

Figure 25:
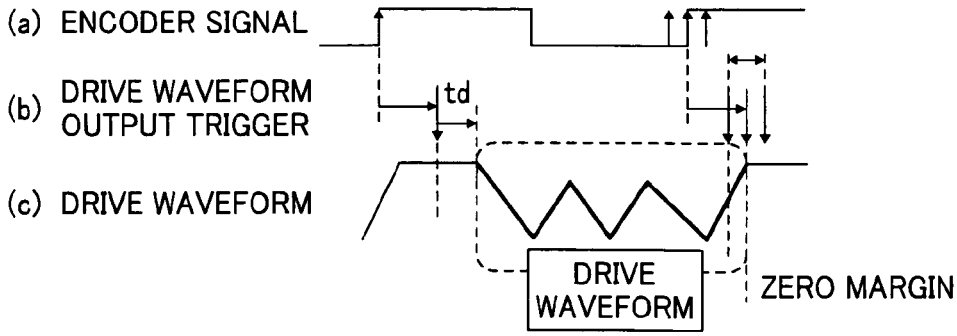
FIG. 25 is a timing chart for explaining of a third example of ratio change.
Figure 26:
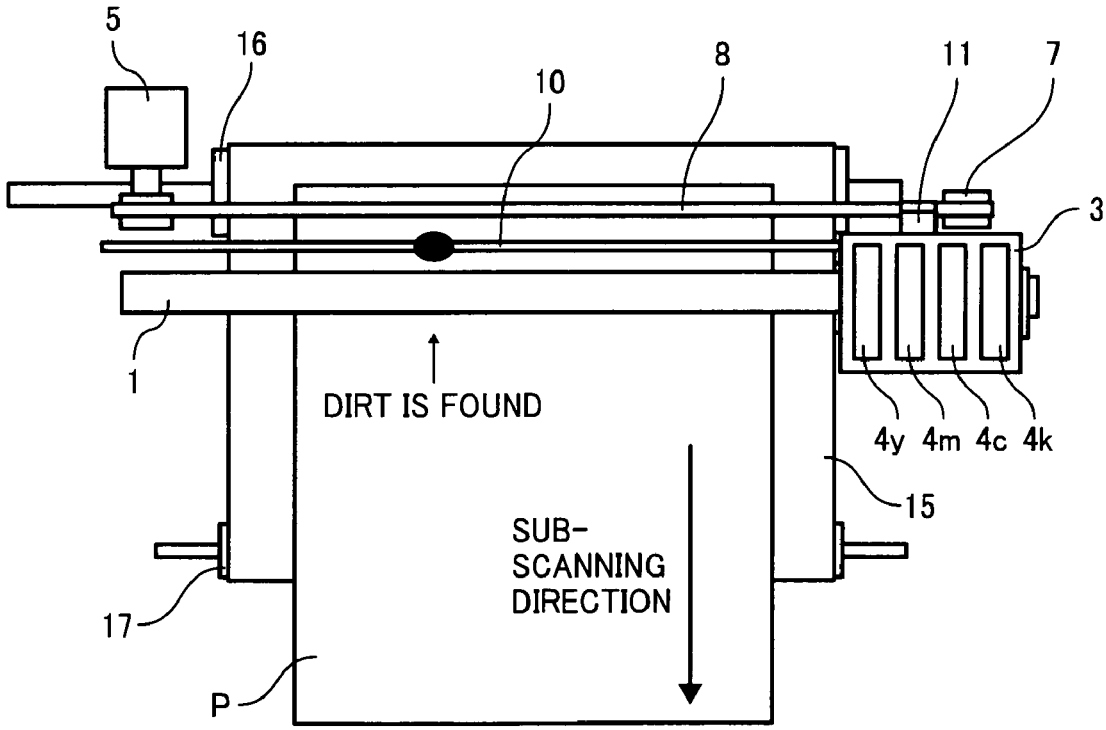
FIG. 26 is a plan view for explaining a method for notifying a dirt position.

In a third example shown in FIG. 25, a delay time td is added after a drive waveform output trigger for normal image formation, thereby making the margin M zero.

In the present embodiment, a user notification unit is provided in various forms, such as a unit for printing on the sheet, a unit for displaying on a host computer (PC), a unit for displaying on a display unit on a printer (image forming apparatus), and a unit for voice notification from a PC or image forming apparatus.

In printing on the sheet, the printed sheet can be kept on the apparatus body without completely ejected it with a dirt position being indicated by an arrow or the like on the sheet. This makes it possible to notify a user of the dirt position in a more understandable manner.

According to an aspect of the present invention, dirt on the linear scale can be identified or detected in a simple configuration.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a moving member;

a linear encoder that includes a linear scale and an encoder sensor for reading the linear scale and that detects a position of the moving member;

a detecting unit that detects a moving direction of the moving member; and a control unit that determines that dirt is present on the linear scale when the detecting unit detects a change in the moving direction of the moving member while the moving member is moving at a constant speed.

2. The image forming apparatus according to claim 1, wherein the moving member includes a recording head.

3. The image forming apparatus according to claim 1, further comprising a notifying unit that notifies detection of dirt on the linear scale and a position at which the dirt is detected.

4. An image forming apparatus comprising:

a moving member;

a linear encoder that includes a linear scale and an encoder sensor for reading the linear scale and that detects a position of the moving member;

a detecting unit that detects a moving direction of the moving member;

a setting unit that sets a changing position at which the moving member changes a moving direction; and a control unit that determines that dirt is present on the linear scale when the detecting unit detects a change in the moving direction of the moving member before the linear encoder detects that the moving member reaches the changing position.

5. The image forming apparatus according to claim 4, wherein the moving member includes a recording head.

6. The image forming apparatus according to claim 4, further comprising a notifying unit that notifies detection of dirt on the linear scale and a position at which the dirt is detected.

7. An image forming apparatus comprising:

a recording head that is configured to move;

a linear encoder that includes a linear scale and an encoder sensor for reading the linear scale and that detects a position of the recording head;

a control unit that determines a print timing based on a signal from the linear encoder and outputs a drive waveform for driving the recording head based on the print timing; and a determining unit that determines, when an instruction for detecting dirt on the linear scale is received, a ratio of a time interval from the print timing to an output time period of a signal for causing the recording head to perform printing to be different from that for normal image formation, and forms an image on a recording medium that can be used to check if dirt is present on the linear scale.

8. The image forming apparatus according to claim 7, wherein the determining unit changes the ratio by increasing a moving speed of the moving member higher than that for normal image formation.

9. The image forming apparatus according to claim 7, wherein the determining unit changes the ratio by making the output time period of the signal for causing the recording head to perform printing to be longer than that for normal image formation.

10. The image forming apparatus according to claim 7, wherein the ratio is changed by delaying a time point of outputting the signal for causing the recording head to perform printing after the print timing compared with that for normal image formation.

11. The image forming apparatus according to claim 7, further comprising a notifying unit that notifies detection of dirt on the linear scale and a position at which the dirt is detected.

* * * * *